US011591537B2

(12) United States Patent
Litters et al.

(10) Patent No.: US 11,591,537 B2
(45) Date of Patent: Feb. 28, 2023

(54) LUBRICATING GREASE COMPRISING METAL SOAPS AND METAL COMPLEX SOAPS BASED ON R-10-HYDROXYOCTADECANOIC ACID

(71) Applicant: FUCHS PETROLUB SE, Mannheim (DE)

(72) Inventors: Thomas Litters, Hettenleidelheim (DE); Florian Hahn, Lambsheim (DE); Rolf Luther, Speyer (DE); Markus Urban, Mannheim (DE); Angela Robben, Mannheim (DE)

(73) Assignee: FUCHS PETROLUB SE, Mannheim (DE)

( * ) Notice: Subject to any disclaimer, the term of this patent is extended or adjusted under 35 U.S.C. 154(b) by 0 days.

(21) Appl. No.: 17/604,189

(22) PCT Filed: Apr. 24, 2020

(86) PCT No.: PCT/DE2020/100338
§ 371 (c)(1),
(2) Date: Oct. 15, 2021

(87) PCT Pub. No.: WO2020/216417
PCT Pub. Date: Oct. 29, 2020

(65) Prior Publication Data

US 2022/0186135 A1 Jun. 16, 2022

(30) Foreign Application Priority Data

Apr. 26, 2019 (DE) ..... 102019110921.3

(51) Int. Cl.

| | |
|---|---|
| ***C10M 117/04*** | (2006.01) |
| ***C10M 129/10*** | (2006.01) |
| ***C10M 129/26*** | (2006.01) |
| ***C10M 133/12*** | (2006.01) |
| ***C10M 137/02*** | (2006.01) |

(Continued)

(52) U.S. Cl.

CPC ..... *C10M 117/04* (2013.01); *C10M 129/10* (2013.01); *C10M 129/26* (2013.01); *C10M 133/12* (2013.01); *C10M 137/02* (2013.01); *C10M 139/00* (2013.01); *C10M 141/12* (2013.01); *C10M 169/00* (2013.01); *C10M 177/00* (2013.01); *C10M 2203/1006* (2013.01); *C10M 2205/0206* (2013.01); *C10M 2207/023* (2013.01); *C10M 2207/1265* (2013.01); *C10M 2215/26* (2013.01); *C10M 2223/049* (2013.01); *C10M 2227/061* (2013.01); *C10N 2030/02* (2013.01); *C10N 2030/06* (2013.01); *C10N 2030/10* (2013.01); *C10N 2030/12* (2013.01); *C10N 2040/02* (2013.01); *C10N 2040/04* (2013.01); *C10N 2050/10* (2013.01); *C10N 2070/00* (2013.01)

(58) Field of Classification Search

CPC ..... C10M 117/04; C10M 129/10; C10M 129/26; C10M 133/12; C10M 137/02; C10M 139/00; C10M 141/12; C10M 169/00; C10M 177/00; C10M 2203/1006; C10M 2205/0206; C10M 2207/023; C10M 2207/1265; C10M 2215/26; C10M 2223/049; C10M 2227/061; C10M 2201/056; C10M 2201/0876; C10M 2201/102; C10M 2201/1036; C10M 2201/1056; C10M 2203/1025; C10M 2205/0285; C10M 2207/026; C10M 2207/10; C10M 2207/1225; C10M 2207/1236; C10M 2207/1256; C10M 2207/1276; C10M 2207/1285; C10M 2207/2865; C10M 2213/0626; C10M 2215/064; C10M 2215/1026; C10M 2217/0456; C10M 2223/026; C10N 2030/02; C10N 2030/06; C10N 2030/10; C10N 2030/12; C10N 2040/02; C10N 2040/04; C10N 2050/10; C10N 2070/00; C10N 2010/12; C10N 2030/08; C10N 2030/40; C10N 2030/68; C10N 2040/046; C10N 2040/14; C10N 2040/25

See application file for complete search history.

(56) References Cited

U.S. PATENT DOCUMENTS

| | | | | |
|---|---|---|---|---|
| 4,802,999 | A * | 2/1989 | Koizumi | C10M 117/04 508/159 |
| 6,172,013 | B1 | 1/2001 | Holt et al. | |
| 2008/0176776 | A1 | 7/2008 | E. et al. | |
| 2012/0136074 | A1* | 5/2012 | Weiss | A61Q 19/00 405/128.75 |
| 2019/0160006 | A1* | 5/2019 | Deshayes | A61K 8/342 |

FOREIGN PATENT DOCUMENTS

| | | | | |
|---|---|---|---|---|
| CA | 3075814 | A1 * | 4/2019 | C10M 105/24 |
| DE | 102007048091 | A1 | 6/2008 | |
| EP | 3461901 | A1 | 4/2019 | |

(Continued)

OTHER PUBLICATIONS

Stereospecificity of Microbial Hydrations of Oleic Acid To 1 Hydroxystearic Acid by Wei Yang Lary Dostal Adn John PN Rosazza Applied and Environmental Microbiology p. 281-284 Jan. 1993 (Year: 19931.*

Biotransformation of Aliphatic Hydrocarbons and Fatty Acids P1-40 by Ching T Hou AO9282 Chapter 15 Aug. 20, 2006 21:09 Karthia 15207 XML Model CRC13A PP1-39 (Year: 2006).*

(Continued)

*Primary Examiner* — Pamela H Weiss

(74) *Attorney, Agent, or Firm* — D'Ambrosio & Menon, PLLC; Usha Menon

(57) ABSTRACT

The invention relates to lubricating greases based on alkali metal soaps and/or earth-alkali metal soaps and metal complex soaps based on (R)-10-hydroxyoctadecanoic acid and to the use thereof.

20 Claims, No Drawings

(51) Int. Cl.

| | |
|---|---|
| ***C10M 139/00*** | (2006.01) |
| ***C10M 141/12*** | (2006.01) |
| ***C10M 169/00*** | (2006.01) |
| ***C10M 177/00*** | (2006.01) |
| ***C10N 30/02*** | (2006.01) |
| ***C10N 30/06*** | (2006.01) |
| ***C10N 30/10*** | (2006.01) |
| ***C10N 30/12*** | (2006.01) |
| ***C10N 40/02*** | (2006.01) |
| ***C10N 40/04*** | (2006.01) |
| ***C10N 50/10*** | (2006.01) |
| ***C10N 70/00*** | (2006.01) |

(56) References Cited

FOREIGN PATENT DOCUMENTS

| | | | | | |
|---|---|---|---|---|---|
| WO | 2008119735 | A1 | | 10/2008 | |
| WO | WO-2017178236 | A1 | * | 10/2017 | ..... A61K 8/062 |
| WO | 2019063718 | A1 | | 4/2019 | |

OTHER PUBLICATIONS

Matthias Engleder et al: "Structure-Based Mechanism of Oleate Hydratase from Elizabethkingia meningoseptica", Chembiochem 2015, 16, p. 1730-1734, XP055315413, ISSN: 1439-4227, DOI: 10.1002/cbic.201500269.

Matthias Engleder et al. "Structure based mechanism of oleate hydratase from Elizabethkingia meningoseptica" Chembiochem, vol. 16, No. 12 (Aug. 17, 2015), pp. 1730-1734, XP055315413.

* cited by examiner

LUBRICATING GREASE COMPRISING METAL SOAPS AND METAL COMPLEX SOAPS BASED ON R-10-HYDROXYOCTADECANOIC ACID

The invention relates to lubricating greases based on alkali metal soaps and/or alkaline-earth metal soaps and metal complex soaps based on R-10-hydroxyoctadecanoic acid and their use.

BACKGROUND OF THE INVENTION

For many technical applications or tribosystems, it is important to use lubricants to reduce friction and wear on the contact surfaces of moving parts. Depending on the application, lubricants of different consistencies can be used. Lubricating oils have a liquid and flowable consistency, while lubricating greases have a semi-solid to solid—often gel-like—consistency. A lubricating grease is characterised in that a liquid oil component is taken up and held by a thickener component. The pasty nature of a lubricating grease and its property of being spreadable and easily plastically deformable, together with the property of being adhesive, ensures that the lubricating grease wets the lubricating point and that the lubricating effect unfolds on the tribologically stressed surfaces.

Lubricating greases contain a thickening agent that is homogeneously distributed in a base oil. Additional additives, such as emulsifiers, are often used to ensure that the thickening agent disperses stably in the base oil. A wide variety of substances are known as base oils. Organic and inorganic compounds are used as thickening agents. Moreover, additives are often added to the lubricating grease to improve wear protection, friction behaviour, ageing stability and corrosion protection, among other things.

The most important viscoelastic properties of a lubricating grease include the flow point and the shear viscosity. Both have a great influence on the efficiency of grease-lubricated drives or bearing arrangements, especially when elastohydrodynamic lubrication (EHL) is present at high sliding speeds or rotational speeds. Particularly at low application temperatures, flow point and shear viscosity have a great influence on the so-called breakaway torque and running torque of grease-lubricated components and aggregates.

Greases are widely used for lubrication purposes in the automotive and aerospace industries. Compared to oils, they have numerous advantages in terms of design and maintenance. Therefore, they are used to lubricate a large number of moving parts in passenger cars and aircraft where oil lubrication fails.

The viscoelastic behaviour of lubricating greases also has disadvantages, which can be seen in particular when operating lubricated components at very low temperatures. When starting up a largely cooled vehicle (winter, arctic regions), the "breakaway torque" is particularly noticeable when grease-lubricated vehicle components such as steering systems, sunroofs, window lifters, side mirror adjusters or door locks have to be operated manually or are operated with low servo-electric drive power. In the automotive industry, lubricating greases must therefore usually function reliably down to a temperature of at least −40° C. In aviation, lubricating greases must work reliably at temperatures as low as −54° C., in some cases even as low as −73° C. The lubricating grease in the landing gear wheel bearings must not fail during landing, even if the aircraft has been at high altitude for a long time and the landing gear has been exposed to very low temperatures. The "breakaway torque" of aircraft lubricating greases must not exceed a certain value.

Often, the design of maximum torques of grease-lubricated components such as gears, plain or roller bearings and all other types of tribological pairings depends on the quality of the lubricating grease used for lubrication. Low flow point and shear viscosity at low temperatures lead to reduced breakaway and running torques and allow designers to select aggregates with comparatively low drive power. This plays a particularly important role in vehicles in which electric drives are used, e.g., in hybrid vehicles or fully electric vehicles. By using lubricating greases with particularly low adhesion and sliding friction at lower application temperatures, for example −40° C., reduced starting and running torques lead to a lower demand for electrical drive power and electricity, which on the one hand extends the range of battery-driven vehicles and on the other hand makes it possible to use power cables with a smaller cross-sectional area and thus save weight in the on-board supply system.

A high degree of practical experience is required to create a lubricating grease of high utility value depending on the lubrication and equipment requirements.

Hydroxyoctadecanoic acid, in particular 12-hydroxyoctadecanoic acid (12-hydroxystearic acid), is a fatty acid that has been used for some time for the production of metal soap greases, especially lithium soap greases and lithium complex soap greases. The starting product for 12-hydroxyoctadecanoic acid or its esters or triglycerides is ricinoleic acid ((9Z,12R)-12-hydroxy-9-octadecenoic acid) and its triglyceride, the so-called castor oil, which is mainly obtained from the castor plant. For this purpose, the unsaturated hydroxy fatty acid ricinoleic acid or its triglyceride is converted into a saturated hydroxy fatty acid by hydrogenation to make it storage-stable and increase its thermal stability. To date, other hydroxyoctadecanoic fatty acids such as 10-hydroxyoctadecanoic acid have hardly any technical significance, even though they are repeatedly cited in passing in intellectual property rights or in the literature, such as in U.S. Pat. No. 4,802,999 A, EP 3461901 A1 or Matthias Engleder et al. "Structure-Based Mechanism of Oleate Hydratase from *Elizabethkingia meningoseptica*", Chem. Bio-Chem., 16 (2015), pages 1730-1734, without that the R-form has been specifically mentioned or actually has been used as a component of the thickener.

Disadvantages of the Prior Art and Object of the Invention

Especially in the production of lithium greases, but also in the production of other metal soap greases based on 12-hydroxyoctadecanoic acid, comparatively high contents of metal soap are needed as a thickener to obtain the desired consistency. This means that such lubricating greases can lead to increased friction losses in rolling bearing and gear applications or other grease-lubricated tribosystems. The object of the invention is to minimise the disadvantages described above with regard to efficiency and low-temperature behaviour.

SUMMARY OF THE INVENTION

This object is achieved by the subject matter of the independent claims. Preferred embodiments are the subject matter of the subordinate claims or are described below The lubricating grease composition according to the invention contains a) at least one base oil;

b) at least one additive;

c) at least one thickener, wherein said at least one thickener is or comprises a metal soap and/or metal complex soap formed from at least one alkali and/or alkaline earth metal ion and at least one carboxylate, wherein the carboxylate is composed of a C16 to C18 fatty acid, wherein the C16 to C18 fatty acid comprises at least one 10-hydroxyoctadecanoic acid (R-10-hydroxystearic acid) and the 10-hydroxyoctadecanoic acid has an enantiomeric purity with respect to the R-isomer of greater than 80% wt. %, preferably greater than 90 wt. % and in particular greater than 98 wt. %, wherein a metal complex soap, if used, comprises a complexing agent (hereinafter in short the metal soap and/or metal complex soap used according to the invention).

Surprisingly, it has been found that an enzymatically produced R-10 hydroxyoctadecanoic acid with an enantiomeric purity greater than 80% shows particularly good thickening performance (100%=sum of R and S isomers). In the same base oil and additive matrix, a 10-hydroxyoctadecanoic acid with a high R content produced in this way clearly showed a thickening effect that was, e.g., more than 50% better than that of a 12-hydroxyoctadecanoic acid.

10-Hydroxyoctadecanoic acid (10-hydroxystearic acid, CAS 638-26-6) can be produced enzymatically, as already published by G. Schroepfer in Biological Chemistry (1966), 241 (22). Both the R and S forms can be used for lubricating grease production.

The structural form of the R-form is:

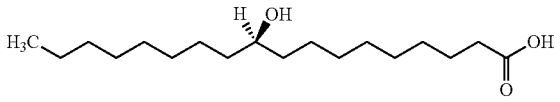

The substrate for the enzymatic conversion is predominantly (9Z)-octadeca-9-enoic acid (oleic acid), which can be produced from domestic "high-oleic" sunflower oil, e.g., with a purity of greater than 92% (9Z)-octadeca-9-enoic acid, but also from technical grade with a purity of greater than 60% (9Z)-octadeca-9-enoic acid. By-products in the qualities are for example hexadecanoic acid (palmitic acid), hexadecenoic acid (palmitoleic acid), octadecanoic acid (stearic acid) or polyunsaturated fatty acids such as linoleic acid ((9Z,12Z)-octadeca-9,12-dienoic acid) or linolenic acid ((9Z,12Z,15Z)-octadeca-9,12,15- trienoic acid).

One advantage of this enzymatic method is that it uses domestic raw feed materials and thus expands the supply chain to include domestic raw starting materials. In addition to "high-oleic" sunflower oil, for example, it is possible to use high-carbon waste streams containing unsaturated C18 acids or esters for the production of 10-hydroxyoctadecanoic acid. Specifically, high-carbon waste streams can be used on the one hand as a nutrient for enzyme production, and on the other hand as a "feedstock" for the presentation of the target products. Used edible fats and oils, residues from biodiesel production (e.g., glycerol, fatty acids, methyl esters) and other industrial by-products can be used as basic substances for material utilisation.

12-Hydroxyoctadecanoic acid (12-hydroxystearic acid, CAS 106-14-9) is commercially available, e.g., from Sigma-Aldrich, or from Nidera B.V. 12-Hydroxyoctadecanoic acid is chemically produced from castor oil by hydrolysis and hydrogenation. Castor oil is mainly produced in India, Brazil and China. The purity of commercially available 12-hydroxyoctadecanoic acid is usually 80-98 wt. %.

The good thickening effect of R-10-hydroxyoctadecanoic acid is also given, for example, when other fatty acids with chain length C16 to C18, such as hexadecanoic acid (palmitic acid) (C16:0), 9-hydroxyhexadecanoic acid, octadecanoic acid (stearic acid), (9Z)-octadeca-9-enoic acid (oleic acid) or polyunsaturated fatty acids such as, e.g., linoleic acid ((9Z,12Z)-octadeca-9,12-dienoic acid) or linolenic acid ((9Z,12Z,15Z)-octadeca-9,12,15-trienoic acid) in unhydroxylated or hydroxylated form continue to be used in metal soap production, in particular together with R-10-hydroxyoctadecanoic acid.

The C16 to C18 fatty acids for the production of the metal soap and/or metal complex soaps used according to the invention consist of more than 50% by weight of 10-hydroxystearic acid and are preferably further characterised individually or jointly as follows:

- The C16 to C18 fatty acids consist of more than 80 wt. % and in particular more than 95 wt. % of 10-hydroxystearic acid.
- The C16 to C18 fatty acids contain in particular greater than 0.5 wt. %, preferably greater than 1.0 wt. %, and particularly preferably 1 to 10 wt. % of hexadecanoic acid.
- The C16 to C18 fatty acids contain in particular greater than 0.2 wt. %, preferably greater than 0.5 wt. %, and particularly preferably 1 to 10.0 wt. % of hydroxyhexadecanoic acid, in particular 9-hydroxyhexadecanoic acid.
- The C16 to C18 fatty acids contain in particular greater than 0.2 wt. %, preferably greater than 0.5 wt. %, and particularly preferably 1 to 10.0 wt. % of octadecanoic acid.
- The C16 to C18 fatty acids contain in particular greater than 0.2 wt. %, preferably greater than 0.5 wt. %, and preferably 1.0 to 10 wt. % of octadecenoic acid, in particular (9Z)-octadeca-9-enoic acid.
- The C16 to C18 fatty acids contain in particular greater than 0.2 wt. %, preferably greater than 0.5 wt. %, and particularly preferably 1 to 10 wt. % of octadecadienoic acid, in particular (9Z,12Z)-octadeca-9,12-dienoic acid.
- The C16 to C18 fatty acids contain less than 1 wt. % of 12-hydroxy-9-octadecenoic acid, in particular (9Z,12R)-12-hydroxy-9-octadecenoic acid, preferably less than 0.2 wt. %.
- The C16 to C18 fatty acids contain less than 1 wt. % of 12-hydroxyoctadecanoic acid, in particular less than 0.2 wt. %.
- The hydroxy-substituted C16 to C18 fatty acids are obtainable from an enzymatic conversion of the corresponding unsaturated C16 to C18 fatty acids.
- The C16 to C18 fatty acids are obtainable from edible fats, in particular used edible fats and/or biodiesel, comprising at least one enzymatic conversion.

The metal soap and/or metal complex soap used according to the invention are in particular

- a lithium soap or lithium complex soap or
- a lithium/calcium soap or lithium/calcium complex soap, or
- a calcium soap or calcium complex soap.

Surprisingly, it has thus been found that lubricating greases based on R-10-hydroxyoctadecanoic acid have significantly lower thickener contents with the same consistency and preferably require at least 30 wt. % less thickener as well as at least 30 wt. % less lithium hydroxide monohydrate for their production.

Lubricating greases produced in this way have significantly lower flow pressures, lower flow points as well as significantly lower starting torques in plain bearings, roller bearings and gears, especially at low temperatures. In the particular case of lithium soap and lithium complex soap greases, production costs can be saved by reducing the use of lithium hydroxide monohydrate.

In the case of lubricating greases thickened with lithium soaps, the use of R-10 hydroxyoctadecanoic acid instead of 12-hydroxyoctadecanoic acid also significantly reduces the cost of using Li salts because up to 62% less lithium hydroxide monohydrate is required to form the lithium hydroxyoctadecanate soap. This is an important cost factor for grease manufacturers, especially against the background of increasing lithium demand for battery production as well as for electromobility.

Preferably, the lithium R-10-hydroxyoctadecanate soap is prepared in situ, i.e., by reacting lithium hydroxide monohydrate with R-10-hydroxyoctadecanoic acid, but lithium 10-hydroxyoctadecanate prepared in a separate step can also be mixed into a base oil and thickened by subsequent thermal and mechanical processing.

It could also be demonstrated that, in case of steel/steel contact, the coefficient of sliding friction of a lubricating grease based on R-10-hydroxyoctadecanoic acid is lower than that of a comparable lubricating grease based on 12-hydroxyoctadecanoic acid, e.g., by up to 37%.

DETAILED DESCRIPTION OF THE INVENTION

The composition according to the invention comprises at least:

a) a base oil or a base oil mixture from 55 to 98 wt. % and in particular from 70 to 97 wt. %, preferred base oils being, e.g., polyalphaolefins, mineral oils and/or esters;
b) additives from 0.5 to 40 wt. % and in particular from 2 to 20 wt. %,
c) a thickener, wherein the thickener is or comprises a metal soap or a metal complex soap comprising a R-10 hydroxyoctadecanate metal soap, and the metal soap used according to the invention or the metal complex soap used according to the invention (then with complexing agent) is contained from 1.5 to 25 wt. %, preferably 3 to 10 wt. % (with respect to the metal soap) or from 1.5 to 40 wt. % with respect to the metal complex soap, comprising 0.1 to 20 wt. % of complexing agent, preferably comprising from 0.1 to 10 wt. % of complexing agent, and the metal soap salt used for production is a metal hydroxide of alkali and/or alkaline earth hydroxides (metal soaps used according to the invention).

The specified wt. % refer to the total composition and each apply independently of each other.

Standard lubricating oils that are liquid at room temperature are suitable as base oils. In particular, the base oil has a kinematic viscosity of 14 to 2500 $mm^2/s$, preferably 30 to 500 $mm^2/s$, in each case at 40° C.

The base oils can be classified as mineral oils or synthetic oils. Mineral oils are considered to be naphthenic mineral oils and paraffinic mineral oils, according to API Group I classification. Chemically modified low-aromatic and low-sulphur mineral oils with a low content of saturated compounds and a viscosity/temperature behaviour that is improved as compared to Group I oils, classified according to API Group II III, Group III+ and synthetic oils produced from natural gas in the so-called gas-to-liquid process (GTL oils) are also suitable.

Examples of synthetic oils are di- or polyethers, esters, polyalphaolefins, polyglycols and alkylaromatics and mixtures thereof. The di-ether compound can be a compound with aliphatic residues and/or aromatic residues (e.g., alkylated diphenyl ethers). The polyether compound may have free hydroxyl groups, but may also be fully etherified or end-group-esterified and/or made of a starting compound with one or more hydroxy and/or carboxyl groups (—COOH). Diphenyl ethers or polyphenyl ethers, alkylated if applicable, are also possible as sole components or, even better, as mixed components. Suitable esters are esters of an aromatic di-, tri- or tetracarboxylic acid with one of C2 to C30 alcohols or a mixture thereof, esters of adipic acid, sebacic acid, trimethylolpropane, neopentyl glycol, pentaerythritol or dipentaerythritol with aliphatic branched or unbranched, saturated or unsaturated C2 to C22 carboxylic acids, C18 dimeric acid esters with C2 to C22 alcohols, complex esters, as individual components or in any mixture desired.

Particularly suitable base oils are or contain polyalphaolefins, e.g., those that are obtainable from polymerisation, if necessary using metallocene catalysts, C4 and C14 LAOs (LAO=linear alpha olefin), C6 and C16 LAOs; C8, C10 and C12 LAOs; C8 and C14 LAOs; C6, C10 and C14 LAOs; C4 and C12 LAOs as copolymers or as mixtures of the respective homopolymers.

It has further been found that in contrast to conventional 12-hydroxyoctadecanate metal greases, lubricating greases based on metal R-10-hydroxyoctadecanate, especially in base oils containing or consisting of polyalphaolefins, exhibit an unexpected advantage in low-temperature behaviour and efficiency. In these properties, the soaps used according to the invention differ significantly from conventional 12-hydroxyoctadecanate soaps.

Optionally, in addition to the C16 to C18 fatty acids as described above, other fatty acids can also be reacted with metal salts such as metal hydroxides to obtain further metal soaps. They may be alkali or alkaline earth salts of one or more saturated or unsaturated monocarboxylic acids having 10 to 15 and/or 19 to 24 carbon atoms, if necessary substituted like preferred corresponding hydroxycarboxylic acids. Suitable carboxylic acids are, for example, lauric acid, myristic acid or behenic acid. In addition to the unbranched-chain fatty acids mentioned, saturated or unsaturated branched-chain fatty acids can also be used. Naphthenic acids, neodecanoic acids or comparable neo acids can also be used.

Simple, mixed or complex soaps based on Al-, Bi-, Ti-salts and carboxylic acids or on Li-, Na-, Mg-, Ca-, Al-, Bi-, Ti-salts and sulphonic acids can also be added as further metal soaps during the base fat production or later as an additive. Alternatively, these soaps can also be formed in situ during the production of the metal soaps used according to the invention.

Instead of the fatty acids with free acid group, appropriate lower alcohol esters with saponification can also be used in the production of the respective metal soaps, e.g., appropriate triglycerides as well as the methyl, ethyl, propyl, isopropyl or sec-butyl acetates of the acid/hydroxy acid, in order to achieve a better dispersion.

In the metal complex soap embodiment, complexing agents are used during production in addition to the metal soaps already described. Complexing agents within the meaning of the present invention are:

(a) the alkali and/or alkaline earth salts of a saturated or unsaturated monocarboxylic acid or also hydroxycarboxylic acids having 2 to 8, in particular 2 to 4 carbon atoms, or alkali and/or alkaline earth salts of a dicarboxylic acid having 2 to 16, in particular 2 to 12 carbon atoms, in each case substituted if necessary, and/or (b) the alkali or alkaline earth salt of boric acid and/or phosphoric acid, in particular reaction products with LiOH. and/or $Ca(OH)_2$, or the reaction product of alkali or alkaline earth hydroxide, in particular LiOH and/or $Ca(OH)_2$ with esters of boric acid or phosphoric acid, and/or (c) esters of boric acid and phosphoric acid with unbranched or branched alkyl groups having 2 to 32 carbon atoms, preferably 8 to 32 carbon atoms.

Preferably, the complexing agent is (a).

Particularly suitable monocarboxylic acids are acetic acid and propionic acid. Also suitable are hydroxybenzoic acids such as para-hydroxybenzoic acid, salicylic acid, 2-hydroxy-4-hexylbenzoic acid, metahydroxybenzoic acid, 2,5-dihydroxybenzoic acid (gentisic acid), 2,6-dihydroxybenzoic acid (gamma-resorcylic acid) or 4-hydroxy-4-methoxybenzoic acid. Particularly suitable dicarboxylic acids are adipic acid ($C_6H_{10}O_4$), sebacic acid ($C_{10}H_{18}O_4$), azelaic acid ($C_9H_{16}O_4$) and/or 3-tert.-butyladipic acid ($C_{10}H_{18}O_4$).

For example, metaborate, diborate, tetraborate or orthoborate, such as monolithium orthoborate, can be used as borate (b). Possible phosphates are alkali (preferably lithium) and alkaline earth (preferably calcium) dihydrogen phosphate-hydrogen phosphateor-pyrophosphate, or calcium or lithium hydroxyapatite. The esters of boric acid and phosphoric acid can be those with unbranched or branched alkyl groups having 2 to 32, preferably 8 to 32 carbon atoms.

Optionally, bentonites, such as montmorillonite (the sodium ions of which may be replaced or partially replaced with organically modified ammonium ions, if necessary), aluminosilicates, aluminas, hydrophobic and hydrophilic silicas, oil-soluble polymers (e.g., polyolefins, poly(meth) acrylates, polyisobutylenes, polybutenes or polystyrene copolymers), polyurea or polyurea-polyurethane or PTFE can be used as co-thickeners. The bentonites, aluminosilicates, aluminas, silicas and/or oil-soluble polymers may be added to produce the base fat or added later as an additive in the second step.

During or after the production of the metal or metal complex soaps, lignin derivatives can also be added as co-thickeners or as additives. Lignin derivatives are effective components in lubricating greases and can be used to improve wear protection properties and corrosion load properties.

Therein, the lignin derivatives can represent multifunctional components. Due to their high number of polar groups and aromatic structures, their polymeric structure and low solubility in all types of lubricating oils, powdery lignins and/or lignosulfonates are also suitable as solid lubricants in lubricating greases and lubricating pastes. In addition, the phenolic hydroxyl groups contained in lignin and lignosulfonates provide an ageing-inhibiting effect. In the case of lignosulfonates, the sulphur content in lignosulfonates promotes the EP/AW effect in greases. Preferably, lignins and/or calcium and/or sodium lignosulfonate or mixtures thereof are used. However, kraft lignins, soda lignins or organosolv lignins can also be used. Also possible is the addition of bio-based oligomers or polymers as solid lubricants or co-thickeners such as triterpenes, cellulose or modified cellulose, chitin and/or chitosan.

In particular, the thickener (metal soaps according to the invention, further metal soaps and co-thickeners) is used in such a way that the composition contains enough thickener to obtain a cone penetration value (worked penetration) of 210 to 475 mm/10 (at 25° C.), preferably 230 to 385 mm/10 (at 25° C.) (determined according to DIN ISO 2137 or ASTM D 0217-97).

The compositions according to the invention may further contain additives as additional substances. Common additives in the sense of the invention are antioxidants, anti-wear agents, corrosion inhibitors, detergents, dyes, lubricity improvers, adhesion improvers, viscosity additives, friction modifiers, high-pressure additives and metal deactivators.

Examples of these are:

primary antioxidants such as amine compounds (e.g., alkylamines or 1-phenyl-aminonaphthalene), aromatic amines such as phenyl-naphthylamines or diphenylamines or polymeric hydroxyquinolines (e.g., TMQ), phenol compounds (e.g., 2.6-di-tert-butyl-4-methylphenol), zinc dithiocarbamate or zinc dithiophosphate;

secondary antioxidants such as phosphites, e.g., tris(2,4-ditert-butylphenylphosphite) or bis(2,4-ditert-butylphenyl)-pentaerythritol diphosphite;

high-pressure additives such as organic chlorine compounds, sulphur or organic sulphur compounds, phosphorus compounds, inorganic or organic boron compounds, zinc dithiophosphate, organic bismuth compounds;

active ingredients that improve the "oiliness" such as C2 to C6 polyols, fatty acids, fatty acid esters or animal or vegetable oils;

anti-corrosive agents such as petroleum sulfonate, dinonyl naphthalene sulfonate or sorbitan ester; disodium sebacate, neutral or overbased calcium sulfonates, magnesium sulfonates, sodium sulfonates, calcium and sodium naphthalene sulfonates, calcium salicylates, amine phosphates, succinates, metal deactivators such as benzotriazole or sodium nitrite;

viscosity improvers such as polymethacrylate, polyisobutylene, oligo-dec-1-ene, polystyrenes;

wear protection additives and friction modifiers such as organomolybdenum complexes (OMC), molybdenum-di-alkyl-dithiophosphates, molybdenum-di-alkyl-dithiocarbamates or molybdenum-di-alkyl-dithiocarbamates, in particular molybdenum-di-n-butyl-dithiocarbamate and molybdenum-di-alkyl-dithiocarbamate ($Mo_{2m}Sn(dialkyl\text{-}carbamate)_2$ with m=0 to 3 and n=4 to 1), zinc dithiocarbamate or zinc dithiophosphate; or a trinuclear molybdenum compound corresponding to the formula:

$$Mo_3S_kL_nQ_z$$

wherein L are independently selected ligands having organo groups with carbon atoms as disclosed in U.S. Pat. No. 6,172,013 B1 to render the compound soluble or dispersible in the oil, wherein n ranges from 1 to 4, k ranges from 4 to 7, wherein Q is selected from the group of neutral electron donor compounds consisting of amines, alcohols, phosphines and ethers, and wherein z ranges from 0 to 5 and comprises non-stoichiometric values (see DE 102007048091);

friction modifiers such as functional polymers, e.g., oleylamides, polyether and amide based organic compounds, e.g., alkyl polyethylene glycol tetradecylene glycol ether, polyisobutylene succinimide, polyisobutylene succinic imide (PIBSI) or polyisobutylene succinic anhydride (PIBSA).

In addition, the lubricating grease compositions according to the invention contain customary additives against corrosion and oxidation and for protection against metal influences, which act as chelate compounds, radical scavengers, UV converters, reaction layer formers and the like. Additives that improve the hydrolysis resistance of ester base oils, such as carbodiimides or epoxides, can also be added.

Solid lubricants that can be used are, e.g., polymer powders such as polyamides, polyimides or PTFE, melamine cyanurate, graphite, metal oxides, boron nitride, silicates, e.g., magnesium silicate hydrate (talcum), sodium tetraborate, potassium tetraborates, metal sulphides such as molybdenum disulphide, tungsten disulphide or mixed sulphides based on tungsten, molybdenum, bismuth, tin and zinc, inorganic salts of alkali and alkaline earth metals, such as calcium carbonate, sodium and calcium phosphates.

Likewise carbon black or other carbon-based solid lubricants such as nanotubes can be used. Lignin derivatives can also be used as a thickener component or solid lubricant. Also possible are bio-based oligomers or polymers such as triterpenes, modified cellulose, chitin, chitosan or polypeptides.

The lubricating greases according to the invention are particularly suitable for use in plain and roller bearings, gears and/or constant velocity joint shafts in industrial and automotive applications. It is a particular aspect of the present invention to arrive at low-friction lubricating greases, especially at low temperatures, where low breakaway torques and running torques are required and where a low flow point and shear viscosity are advantageous. In the particular case of lubrication of plain and roller bearings and gears and constant velocity joint shafts in automotive engineering, smaller and lighter drives can thus be used and efficiency advantages gained. Lubricating greases produced according to the present invention have, in particular at −35° C., up to 43% lower flow points (measured with the oscillation rheometer according to DIN 51810-2) and up to 50% lower shear viscosities (determined with the shear viscometer according to DIN 51810-1) than comparable lubricating greases. In the test of the flow pressure according to DIN 51805-2, the lubricating greases that are produced according to the present invention show, at −40° C., values which are at least 50% lower than comparable lubricating greases. Furthermore, the lubricating greases according to the invention have sliding friction coefficients in steel/steel contact that are up to 37% lower than those of a comparable lubricating grease based on 12-hydroxyoctadecanoic acid.

Various laboratory test methods are available for testing the flow points and shear viscosity of lubricating greases. One method for determining the flow point using an oscillation rheometer is DIN 51810-2. The flow pressure method according to DIN 51805-2 is also used to determine the lower service temperature of lubricating greases. The flow pressure is the pressure difference from atmospheric pressure required to force a grease string out of a test nozzle under the conditions specified in this standard. It is a measure of the stiffness of a lubricating grease at the respective test temperature and can be used in addition to the test according to DIN 51810-2 as a measure of the flow point.

IP 186 and ASTM D 1478 describe the determination of the starting and running torques of ball bearings. With these test methods, the functionality of lubricating greases can be tested at low temperatures, e.g., −40° C. or −73° C.

Thus, these test methods are part of numerous specifications of the automotive and aerospace industry (civil and military aviation) as well as of user specifications. They have proven to be useful test methods over the years. DIN 51805-2, determination of flow pressure, is mainly used in Germany as a national method to determine the lower service temperature of lubricating greases.

The lubricating greases can be produced, for example, as follows: mixing the salt/metal compound into the carboxylic acid compound, which may be stretched with the base oil component if necessary, plus the complexing agent if necessary, and, if necessary, simultaneously heating the mixture to a temperature above 100° C., in particular above 170° C., to form a thickened lubricating grease product; cooling the lubricating grease product and, if necessary, adding water; applying shear forces to the mixture, e.g., with a toothed colloid mill, a high-pressure homogeniser and/or a three-roller mill. According to a further embodiment of the invention, the thickener is synthesised in situ in the base oil under pressure and at elevated temperature in a closed reaction vessel, such as an autoclave.

The lubricating grease composition can be used for lubricating gears, constant velocity joint shafts, plain and roller bearings, sliding guides, spindle drives, linear drives, ball screws, in particular with a lower operating temperature of less than −20° C., and/or in automobiles, aircraft, drones or helicopters. Other applications include the lubrication of steering systems, sunroofs, window lifters, side mirror adjusters, door locks, chassis wheel bearings, especially in automobiles, aircraft, drones or helicopters. The lubricating grease composition is also suitable for lubricating electric motor bearings, especially in hybrid vehicles or fully electric vehicles.

TRIAL EXAMPLES

Example A (Reference)

Lithium-12-Hydroxyoctadecanoic Acid Fat with Polyalphaolefin 171 g of polyalphaolefin (mixture of PAO 6:PAO 150=3:1) and 45.25 g 12-hydroxyoctadecanoic acid as racemate were put into a stirred-tank reactor and heated to 86° C. Then 6.31 g of lithium hydroxide monohydrate was added, which was previously dissolved in 25 g of distilled water. Subsequently, the substances were heated to 210° C. and then cooled down to less than 100° C. over a period of 20 min, and the additives were added.

The lubricating grease was then homogenised with a three-roller mill and adjusted to the desired consistency by gradually adding further polyalphaolefin. The lubricating grease thus produced had a thickener content of 12.13 wt. % and a worked penetration of 332 0.1 mm.

Examples B1, B2, B3 (Invention)

Lithium-10-Hydroxyoctadecanoic Acid Fats with Polyalphaolefin 171 g of polyalphaolefin (mixture of PAO 6 (metallocene-based):PAO 150=3:1) and 35.16 g R-10-hydroxyoctadecanoic acid were put into a stirred-tank reactor and heated to 91° C. Then 5.07 g of lithium hydroxide monohydrate was added, which was previously dissolved in 21 g of distilled water. Subsequently, the substances were heated to 210° C. and then cooled down to less than 100° C. over a period of 20 min, and the additives were added. The lubricating grease was then homogenised with a three-roller mill and adjusted to the desired consistency by gradually adding further polyalphaolefin. The lubricating greases produced in this way had thickener contents of 4.64 wt. % (B1), 4.97 wt. % (B2) and 5.06 wt. % (B3) and worked penetrations of 339 0.1 mm (B1), 332 0.1 mm (B2) and 320 0.1 mm (B3).

Example C (Reference)

Lithium-12-Hydroxyoctadecanoic Acid Complex Fat with Polyalphaolefin 171 g of polyalphaolefin (mixture of PAO 6:PAO 150=3:1) and 45.25 g 12-hydroxyoctadecanoic acid as racemate were put into a stirred-tank reactor and heated to 91° C. Then 6.31 g of lithium hydroxide monohydrate was added, which was previously dissolved in 25 g of distilled water. Subsequently, the substances were heated to 210° C. and then cooled down to less than 122° C. over a period of 15 min. Then 1.25 g of (tris(2-ethylhexyl)orthoborate was added and cooled down to less than 100° C., and the additives were added. The lubricating grease was then homogenised with a three-roller mill and adjusted to the desired consistency by gradually adding further polyalphaolefin. The grease thus produced had a thickener content of 10.52% and a worked penetration of 328 0.1 mm as well as a dropping point of >300° C.

Example D (Invention)

Lithium R-10-Hydroxyoctadecanoic Acid Complex Fat with Polyalphaolefin 171 g of polyalphaolefin (mixture of PAO 6:PAO 150=3:1) and 35.16 g R-10-hydroxyoctadecanoic acid were put into a stirred-tank reactor and heated to 91° C.

Then 5.07 g of lithium hydroxide monohydrate was added, which was previously dissolved in 21 g of distilled water. Subsequently, the substances were heated to 210° C. and then cooled down to less than 122° C. over a period of 15 min. Then 1.19 g of (tris(2-ethylhexyl)orthoborate was added and cooled down to <100° C., and the additives were added. The lubricating grease was then homogenised with a three-roller mill and adjusted to the desired consistency by gradually adding further polyalphaolefin. The grease thus produced had a thickener content of 4.68 wt. % and a worked penetration of 335 0.1 mm as well as a dropping point of 293° C.

Example E (Reference)

Lithium-12-Hydroxyoctadecanoic Acid Fat with Mineral Oil 107.48 g of mineral oil, Group II (kinematic viscosity=110 $mm^2/s$ at 40° C.) and 22.08 g of 12-hydroxyoctadecanoic acid (racemate) were put into a stirred-tank reactor and heated to 91° C. Then 3.18 g of lithium hydroxide monohydrate was added, which was previously dissolved in 15 g of distilled water. Subsequently, the substances were heated to 210° C. and then cooled down to <100° C. over a period of 20 min, and the additives were added. The lubricating grease was then homogenised with a three-roller mill and adjusted to the desired consistency by gradually adding further mineral oil, Group II SN 600. The lubricating grease thus produced had a thickener content of 8.3% and a worked penetration of 317 0.1 mm.

Example F (Invention)

Lithium-10-Hydroxyoctadecanoic Acid Fat with Mineral Oil 107.12 g of mineral oil, Group II (kinematic viscosity=110 $mm^2/s$ at 40° C.) and 22.04 g of R-10-hydroxyoctadecanoic acid were put into a stirred-tank reactor and heated to 91° C. Then 3.17 g of lithium hydroxide monohydrate was added, which was previously dissolved in 15 g of distilled water. Subsequently, the substances were heated to 210° C. and then cooled down to less than 100° C. over a period of 20 min, and the additives were added. The lubricating grease was then homogenised with a three-roller mill and adjusted to the desired consistency by gradually adding further mineral oil, Group II SN 600. The lubricating grease thus produced had a thickener content of 4.21 wt. % and a worked penetration of 328 0.1 mm.

Example G (Reference)

Lithium-12-Hydroxyoctadecanoic Acid Fat with Ester Oil 107.48 g of pentaerythritol ester (with a viscosity of 96 $mm^2/s$ at 40° C.) and 22.08 g of 12-hydroxyoctadecanoic acid were put into a stirred-tank reactor and heated to 91° C.

Then 3.18 g of lithium hydroxide monohydrate was added, which was previously dissolved in 15 g of distilled water. Subsequently, the substances were heated to 210° C. and then cooled down to less than 100° C. over a period of 20 min, and the additives were added. The lubricating grease was then homogenised with a three-roller mill and adjusted to the desired consistency by gradually adding further pentaerythritol ester. The lubricating grease thus produced had a thickener content of 6.13% and a worked penetration of 328 0.1 mm.

Example H (Invention)

Lithium R-10-Hydroxyoctadecanoic Acid Fat with Ester Oil 107.12 g of pentaerythritol ester (with a viscosity of 96 $mm^2/s$ at 40° C.) and 22.04 g of 12-hydroxyoctadecanoic acid were put into a stirred-tank reactor and heated to 91° C. Then 3.17 g of lithium hydroxide monohydrate was added, which was previously dissolved in 15 g of distilled water. Subsequently, the substances were heated to 210° C. and then cooled down to less than 100° C. over a period of 20 min, and the additives were added. The lubricating grease was then homogenised with a three-roller mill and adjusted to the desired consistency by gradually adding further pentaerythritol ester. The lubricating grease thus produced had a thickener content of 4.08 wt. % and a worked penetration of 335 0.1 mm.

In the same base oil and additive matrix, the lubricating greases according to the invention produced with R-10-hydroxyoctadecanoic acid showed a thickening effect that was up to 62% better than that of a 12-hydroxyoctadecanoic acid.

Table of Examples

| | A Reference Normal soap PAO | B1 Invention Normal soap PAO | B2 Invention Normal soap PAO | B3 Invention Normal soap PAO | C Reference Complex soap PAO | D Invention Complex soap PAO |
|---|---|---|---|---|---|---|
| Base oils | | | | | | |
| Mineral oil, Group II (kinematic viscosity = 110 mm2/s at 40° C.) | | | | | | |
| Polyalphaolefin, 75 cSt (mixture PAO6: PAO150, 3:1) | 76.12 | 83.61 | 83.28 | 83.19 | 77.73 | 82.96 |
| Pentaerythritol ester | | | | | | |
| Fatty acids | | | | | | |
| 10-hydroxyoctadecanoic acid type 1*1) | | 4.05 | | | | 4.23 |
| 10-hydroxyoctadecanoic acid type 2*2) | | | 4.34 | | | |
| 10-hydroxyoctadecanoic acid type 3*3) | | | | 4.42 | | |
| 12-hydroxyoctadecanoic acid | 10.65 | | | | 8.76 | |
| Complexing agent | | | | | | |
| Tris(2-ethylhexyl)orthoborate | | | | | 0.49 | 0.45 |
| Alkali hydroxide | | | | | | |
| Lithium hydroxide monohydrate | 1.48 | 0.59 | 0.63 | 0.64 | 1.27 | 0.61 |
| Additives | | | | | | |
| Aminic antioxidant (alkylated diphenylamine) | 2.00 | 2.00 | 2.00 | 2.00 | 2.00 | 2.00 |
| Phenolic antioxidants (sterically hindered phenol) | 0.50 | 0.50 | 0.50 | 0.50 | 0.50 | 0.50 |
| Secondary antioxidant (alkyl phosphite) | 0.50 | 0.50 | 0.50 | 0.50 | 0.50 | 0.50 |
| Wear protection additives*4) | 7.25 | 7.25 | 7.25 | 7.25 | 7.25 | 7.25 |
| Corrosion protection additive (zinc carboxylate) | 1.50 | 1.50 | 1.50 | 1.50 | 1.50 | 1.50 |

*1)Purity >99% of R-10-hydroxyoctadecanoic acid
*2)Purity 91.5% of R-10-hydroxyoctadecanoic acid, 8.5% of octadecanoic acid
*3)Purity 91.5% of R-10-hydroxyoctadecanoic acid, 8.5% of octadecenoic acid
*4)Contains organic compounds based on N, P, S, Zn and Mo

| | E Reference Normal soap Mineral oil | F Invention Normal soap Mineral oil | G Reference Normal soap Ester oil | H Invention Normal soap Ester oil |
|---|---|---|---|---|
| Base oils | | | | |
| Mineral oil, Group II (kinematic viscosity = 110 $mm^2/s$ at 40° C.) | 79.95 | 84.04 | | |
| Polyalphaolefin, 75 cSt (mixture PAO6:PAO150, 3:1) | | | | |
| Pentaerythritol ester | | | 82.09 | 84.17 |
| Fatty acids | | | | |
| 10-hydroxyoctadecanoic acid type 1*1) | 3.68 | | | 3.57 |
| 10-hydroxyoctadecanoic acid type 2*2) | | | | |
| 10-hydroxyoctadecanoic acid type 3*3) | | | | |
| 12-hydroxyoctadecanoic acid | 7.25 | | 5.36 | |
| Complexing agent | | | | |
| Tris(2-ethylhexyl)orthoborate | | | | |
| Alkali hydroxide | | | | |
| Lithium hydroxide monohydrate | 1.05 | 0.53 | 0.77 | 0.51 |
| Additives | | | | |
| Aminic antioxidant (alkylated diphenylamine) | 2.00 | 2.00 | 2.00 | 2.00 |
| Phenolic antioxidants (sterically hindered phenol) | 0.50 | 0.50 | 0.50 | 0.50 |

-continued

| | E Reference Normal soap Mineral oil | F Invention Normal soap Mineral oil | G Reference Normal soap Ester oil | H Invention Normal soap Ester oil |
|---|---|---|---|---|
| Secondary antioxidant (alkyl phosphite) | 0.50 | 0.50 | 0.53 | 0.50 |
| Wear protection additives*4) | 7.25 | 7.25 | 7.25 | 7.25 |
| Corrosion protection additive (zinc carboxylate) | 1.50 | 1.50 | 1.50 | 1.50 |

*1)Purity >99% of R-10-hydroxyoctadecanoic acid

*2)Purity 91.5% of R-10-hydroxyoctadecanoic acid, 8.5% of octadecanoic acid

*3)Purity 91.5% of R-10-hydroxyoctadecanoic acid, 8.5% of octadecenoic acid

*4)Contains organic compounds based on N, P, S, Zn and Mo

| Characteristic values | Unit | Method | A Reference Normal soap Polyalpha-olefin | B1 Invention Normal soap Polyalpha-olefin | B2 Invention Normal soap Polyalpha-olefin | B3 Invention Normal soap Poyalpha-olefin | C Reference Complex soap Polyalpha-olefin |
|---|---|---|---|---|---|---|---|
| Thickener content | % | Calculation*5) | 12.13 | 4.64 | 4.97 | 5.06 | 10.52 |
| Delta LiOH × H2O addition amount (invention in relation to reference) | % | | | −60.14 | −57.43 | −56.76 | |
| Delta thickener (invention in relation to reference) | % | | | −61.75 | −59.03 | −58.29 | |
| Consistency class | 0.1 mm | | NLGI 1 | NLGI 1 | NLGI 1 | NLGI 1 | NLGI 1 |
| Worked penetration Pw 60 | | DIN ISO 2137 | 332 | 339 | 332 | 320 | 328 |
| Dropping point according to IP 396 | ° C. | IP 396 | 210 | 193 | 198 | 205 | 300 |
| Flow pressure at −40° C. | hPa | DIN 51805 | 250 | 125 | | | 200 |
| Delta flow pressure (invention in relation to reference) | % | | | −50.00 | | | |
| Shear viscosity at −35° C, eta E | Pa s | DIN 51810-1 | 60.4 | 31.7 | | | |
| Delta shear viscosity (invention in relation to reference) | % | | | −47.52 | | | |
| Flow point at −35° C. | Pa | DIN 51810-2 | 752 | 425.4 | | | |
| Delta flow point (invention in relation to reference) | % | | | −43.43 | | | |
| Sliding friction coefficient μ at 60° C. | % | See description*6) | 0.102 | 0.083 | | | 0.108 |
| Delta friction value (invention in relation to reference) | % | | | −18.31 | | | |

*5)Sum of the added amount of LiOH monohydrate + fatty acid + complexing agent

*6)12.7-mm ball on 3 surfaces (material 100Cr6), surface pressure in point contact 144 N/mm2, sliding speed 0.057 m/s

| Characteristic values | Unit | Method | D Invention Complex soap Polyalpha-olefin | E Reference Normal soap Mineral oil | F Invention Normal soap Mineral oil | G Reference Normal soap Ester oil | H Invention Normal soap Ester oil |
|---|---|---|---|---|---|---|---|
| Thickener content | % | Calculation*5) | 4.68 | 8.30 | 4.21 | 6.13 | 4.08 |
| Delta LiOH × H2O addition amount (invention in relation to reference) | % | | | −51.97 | | −49.52 | −33.77 |
| Delta thickener (invention in relation to reference) | % | | −55.51 | | −49.28 | | −33.44 |
| Consistency class | 0.1 mm | | NLGI 1 | NLGI 1 | NLGI 1 | NLGI 1 | NLGI 1 |
| Worked penetration Pw 60 | | DIN ISO 2137 | 335 | 317 | 328 | 328 | 335 |
| Dropping point according to IP 396 | C. | IP 396 | 293 | 227 | 191 | 202 | 186 |
| Flow pressure at −40° C. | hPa | DIN 51805 | 150 | 1350 | 950 | 675 | 525 |

-continued

| Characteristic values | Unit | Method | D Invention Complex soap Polyalpha-olefin | E Reference Normal soap Mineral oil | F Invention Normal soap Mineral oil | G Reference Normal soap Ester oil | H Invention Normal soap Ester oil |
|---|---|---|---|---|---|---|---|
| Delta flow pressure (invention in relation to reference) | % | | −25.00 | | −29.63 | | −22.22 |
| Shear viscosity at −35° C., eta E | Pa s | DIN51810-1 | | | | | |
| Delta shear viscosity (invention in relation to reference) | % | | | | | | |
| Flow point at −35° C. | Pa | DIN 51810-2 | | | | | |
| Delta flow point (invention in relation to reference) | % | | | | | | |
| Sliding friction coefficient μ at 60° C. | | See description*6) | 0.082 | 0.107 | 0.068 | 0.120 | 0.079 |
| Delta friction value (invention in relation to reference) | % | | −23.77 | | −37.06 | | −33.97 |

*5)Sum of the added amount of LiOH monohydrate + fatty acid + complexing agent

*6)12.7-mm ball on 3 surfaces (material 100Cr6), surface pressure in point contact 144 N/mm2, sliding speed 0.057 m/s

The invention claimed is:

1. A grease composition comprising:

a) at least one base oil;

b) at least one additive;

c) at least one thickener, wherein said at least one thickener is a metal soap, or a metal complex soap or both composed of at least one alkali or alkaline earth metal ion or both and at least one carboxylate formed from a C16 to C18 fatty acid, wherein the C16 to C18 fatty acid comprises at least R-10-hydroxyoctadecanoic acid and the 10-hydroxyoctadecanoic acid has an enantiomeric purity with respect to the R-isomer of greater than 80 wt. %;

wherein the C16 to C18 fatty acid consists of greater than 50 wt. % of 10-hydroxyoctadecanoic acid; and wherein the composition comprises:

a) 55 to 98 wt. % of the base oil;

b) 0.5 to 40 wt. % of the additive(s); and c1) 1.5 to 25 wt. % of metal soap; or c2) 1.5 to 40 wt. % of the metal complex soap comprising 0.1 to 20 wt. % of complexing agent.

2. The lubricating grease composition according to claim 1, wherein i) the C16 to C18 fatty acid consists of more than 80 wt. % of 10-hydroxyoctadeacanoic acid; or ii) the 10-hydroxyoctadecanoic acid has an enantiomeric purity with respect to the R-isomer of greater than 90 wt. %; or iii) both.

3. The lubricating grease composition according to claim 1, wherein the C16 to C18 fatty acid comprises greater than 0.5 wt. % hexadecanoic acid.

4. The lubricating grease composition according to claim 1, wherein the C16 to C18 fatty acid comprises greater than 0.2 wt. % hydroxyhexadecanoic acid.

5. The lubricating grease composition according to claim 1, wherein the C16 to C18 fatty acid comprises greater than 0.2 wt. % octadecanoic acid.

6. The lubricating grease composition according to claim 1, wherein the C16 to C18 fatty acid comprises octadecenoic acid.

7. The lubricating grease composition according to claim 1, wherein the C16 to C18 fatty acid comprises greater than 0.2 wt. % octadecadienoic acid.

8. The lubricating grease composition according to claim 1, wherein the C16 to C18 fatty acid comprises less than 1 wt % of 12-hydroxy-9-octadecenoic acid.

9. The lubricating grease composition according to claim 1, wherein the C16 to C18 fatty acid comprises less than 1 wt % of 12-hydroxyoctadecanoic acid.

10. The lubricating grease composition according to claim 1, wherein the C16 to C18 fatty acids contain hydroxy-substituted C16 to C18 fatty acids obtained from an enzymatic conversion of the corresponding unsaturated C16 to C18 fatty acid.

11. The lubricating grease composition according to claim 1, wherein the C16 to C18 fatty acids are obtained from edible fats or biodiesel, comprising at least one enzymatic conversion.

12. The composition according to claim 1, wherein the metal soap or metal complex soap is a lithium soap or lithium complex soap or a lithium/calcium soap or lithium/calcium complex soap.

13. The lubricating grease composition according to claim 1, wherein the complexing agent is selected from:

alkali salts or alkaline earth salts or both of a) a saturated or unsaturated monocarboxylic acid or also hydroxy-carboxylic acids having 2 to 8 carbon atoms, or of b) a di-carboxylic acid having 2 to 16 in each case optionally substituted, or alkali or alkaline earth salts of boric acid or phosphoric acid or both, or esters of boric acid or phosphoric acid or both with unbranched or branched alkyl groups having 2 to 32 carbon atoms, or mixtures thereof.

14. The composition according to claim 1, wherein the composition comprises:

a) 70 to 95 wt. % of the base oil;

b) 2 to 20 wt. % of the additive(s); and c1) 3 to 10 wt. % of metal soap; or c2) 1.5 to 40 wt. % of the metal complex soap comprising 0.1 to 10 wt. % of the complexing agent.

15. The lubricating grease composition according to claim 1, wherein the lubricating grease composition comprises a further metal soap or a further metal complex soap of saturated or unsaturated mono-carboxylic acids or also hydroxycarboxylic acids having 10 to 15 or 19 to 24 carbon atoms or both, including mixtures thereof.

16. The lubricating grease composition according to claim 1, wherein the lubricating grease composition further comprises co-thickeners selected from one or more members of the group: aluminosilicates, aluminas, hydrophobic and hydrophilic silicas, polymers, di/poly-ureas, di/poly-urea urethanes and PTFE.

17. The lubricating grease composition according to claim 1, wherein the lubricating grease composition has a cone penetration value (worked penetration) of 210 to 475 mm/10 at 25° C., determined according to ISO 2137.

18. The lubricating grease composition according to claim 1, wherein the base oil has, at 40° C., a kinematic viscosity of from 14 to 2500 $mm^2/s$.

19. The lubricating grease composition according to claim 1, wherein the additive comprises one or more members selected from the following group:

antioxidants;
high-pressure additives;
anti-corrosive agents;
metal deactivators;
viscosity improvers;
wear protection additives;
friction modifiers; and
solid lubricants.

20. A method for preparing a lubricating grease composition according to claim 1 by bringing together a) at least one base oil;

b) at least one additive;

c) at least one thickener, wherein said at least one thickener is a metal soap or metal complex soap composed of alkali or alkaline earth metal ions and an R-10 hydroxyoctadecanoic acid, wherein said metal soap or metal complex soap is prepared in the base oil while being heated to at least 170° C. and said additive is added after cooling down to below 100° C.

* * * * *